US005937075A

United States Patent [19]

Goller

[11] Patent Number: 5,937,075

[45] Date of Patent: Aug. 10, 1999

[54] LOUDSPEAKER

[75] Inventor: Lars Goller, Herning, Denmark

[73] Assignee: Vifa-Speak A/S, Videbaek, German Dem. Rep.

[21] Appl. No.: 08/624,485

[22] PCT Filed: Sep. 30, 1994

[86] PCT No.: PCT/DK94/00363

§ 371 Date: Apr. 4, 1996

§ 102(e) Date: Apr. 4, 1996

[87] PCT Pub. No.: WO95/10165

PCT Pub. Date: Apr. 13, 1995

[30] Foreign Application Priority Data

Oct. 4, 1993 [DK] Denmark ..... 1109/93

[51] Int. Cl.[6] ..... H04R 25/00

[52] U.S. Cl. ..... 381/398; 381/423; 181/171

[58] Field of Search ..... 381/192, 193, 381/202, 203, 204, 396, 398, 432, 423, 424, 429; 181/171, 172, 173; 29/594, 609.1

[56] References Cited

U.S. PATENT DOCUMENTS

| | | | |
|---|---|---|---|
| 2,439,665 | 4/1948 | Marquis | 181/172 |
| 2,537,723 | 1/1951 | Ward | 381/193 |
| 3,201,529 | 8/1965 | Surh | 381/204 |
| 4,235,302 | 11/1980 | Tsukamoto | 381/398 |
| 4,709,392 | 11/1987 | Kato et al. | 381/193 |
| 4,881,617 | 11/1989 | Faraone | 381/202 |
| 5,115,474 | 5/1992 | Tsuchiya et al. | 381/354 |
| 5,148,492 | 9/1992 | Uzawa et al. | 381/202 |
| 5,251,188 | 10/1993 | Parsons et al. | 381/193 |
| 5,255,328 | 10/1993 | Akiniwa et al. | 381/193 |
| 5,371,805 | 12/1994 | Saiki | 381/193 |
| 5,418,337 | 5/1995 | Schreiber | 181/173 |

FOREIGN PATENT DOCUMENTS

| | | | |
|---|---|---|---|
| 0068408 | 6/1977 | Japan | 381/193 |
| 362032799 | 2/1987 | Japan | 381/FOR 153 |
| 0053594 | 3/1987 | Japan | 381/193 |
| 405122791 | 5/1993 | Japan | 381/FOR 153 |

*Primary Examiner*—Huyen Le
*Attorney, Agent, or Firm*—Sixbey, Friedman, Leedom & Ferguson; David S. Safran

[57] ABSTRACT

In quality loudspeakers there are certain distortion problems owing to a lack of damping of the movements of the outer, free edge of the loudspeaker diaphragm (2). In connection with the invention it has been recognized that these problems are widely due to some special interference phenomena originating from the total movement of the diaphragm, and according to the invention it has been found advantageous to provide, in the area of the outer edge (6) of the diaphragm (2), a differentiation with respect to the effective spring characteristic of the edge suspension (8) of the diaphragm. This is achievable in a variety of manners, e.g. already by a cutting off of pieces of the exterior diaphragm zone as secured to the edge suspension.

5 Claims, 1 Drawing Sheet

LOUDSPEAKER

BACKGROUND OF THE INVENTION

1. Field of the Invention

The present invention relates to a loudspeaker having a loudspeaker diaphragm centrally connected with the voice coil of the loudspeaker and at its outer rim connected with a resilient edge suspension, through which the diaphragm is fixed to an associated loudspeaker chassis. The edge suspension is made of a suitable rubber resilient material and is shaped as an annular shell member of an almost half circular cross section, prolonged outwardly in a flat ring flange for connection with the loudspeaker chassis and inwardly in a flange portion, which, in case of a conical diaphragm, has the same cone angle as the diaphragm and serving to hold an outer edge area of the diaphragm in being glued thereto.

The edge suspension is moulded with thin, angular transitions between the edges of the arched resilient portion and the two flange portions, whereby a free movability of the diaphragm is secured. The resilient portion will hold the diaphragm in its desired position of rest, and it is clearly advantageous that the diaphragm is easily movable, as this will of course increase its efficiency.

2. Description of Related Art

In connection with the invention, however, it has been recognized that there is an associated drawback, viz. some resonance phenomena resulting from the lacking attenuation of the kinetic energy as represented by the inertia of the oscillating diaphragm. Predominantly, the energy will be transferred back to the voice coil by propagation through the diaphragm material from the different partial areas of the diaphragm, and just hereby the said resonances may occur. Admittedly, the associated hearable distortion is not marked, but in particular for high quality products it is commercially important if there are distortions that are measurable and hearable by qualified listeners.

SUMMARY OF THE INVENTION

The present invention is based on the assumption that the presence of the resonance or interference phenomena are widely due to the fact that the entire diaphragm is influenced in a fully uniform manner, whereby, lengthwise through the diaphragm material, there may occur identically phased dynamic impacts, which—as a sort of wave fronts—may interfere with reflected fronts and thus generate noticeable resonances. On this background it has been considered to introduce some asymmetry or non-uniformity in the diaphragm structure seen in the roundgoing direction, not for weakening the impacts, but rather for producing a certain spreading of the phasing of the forces through the diaphragm, with the aim of reducing the said interferences, which will be reduced noticeably if the said wave fronts do not appear fully uniformly in the radial or axial direction of the diaphragm.

On this background it has been found that a noticeable improvement is obtained already by the modification of introducing, in connection with fully conventional diaphragms and edge suspensions, a differentiation of the degree of the overlapping between the diaphragm flange of the edge suspension and the outer edge portion of the diaphragm. Normally, the diaphragm edge is fully circular, but in connection with the invention it has been found that already by a cutting off of partial portions of the edge of the diaphragm it is possible to achieve a clearly measurable improvement of the loudspeaker characteristic. Already by cutting off two opposed edge portions a measurable improvement has been noticed, but a cutting off of five partial areas has provided for results that make the invention commercially important.

Through experiments it has been found that the primary effect of the invention is due to the edge suspension uttering itself with a differentiated spring effect round along the edge of the diaphragm, more than to the said clippings producing a differentiated mass distribution of the diaphragm material itself in the edge are thereof. In the non-cut areas the diaphragm edge will reinforce the entire flange of the edge suspension, while the corresponding reinforcement will be much weaker at the middle of the cut areas, such that the flange of the edge suspension will here to a higher degree participate directly in the resilient system of the edge suspension and thus, locally, result in another spring characteristic thereof. It is the resulting variation in this characteristic which will primarily condition the desired effect with respect to a non-uniform wave reflection from the diaphragm edge area.

While the associated variation in the mass distribution of the diaphragm along the circumference thereof may, per se, be rather unimportant, it may be highly effective if use is made of a varying mass distribution in the edge suspension itself, as this will also involve a variation in the associated local spring characteristic.

Various proposals are known, dealing with some differentiation round along the outer edge of the diaphragm, but with other aims, in providing for a uniform reaction from the edge suspension area by making the same mass constant or by outbalancing irregularities at the central part of the diaphragm. In connection with the invention it is just such an outbalancing which is counteracted by the introduction of decided uneven spring conditions in the edge suspension.

In the following the invention is explained in more detail with reference to the drawings.

BRIEF DESCRIPTION OF THE DRAWINGS

FIG. 1 is a front view of a loudspeaker diaphragm according to the invention, shown with an associated edge suspension element, while

DETAILED DESCRIPTION OF THE PREFERRED EMBODIMENT

Figure 1:
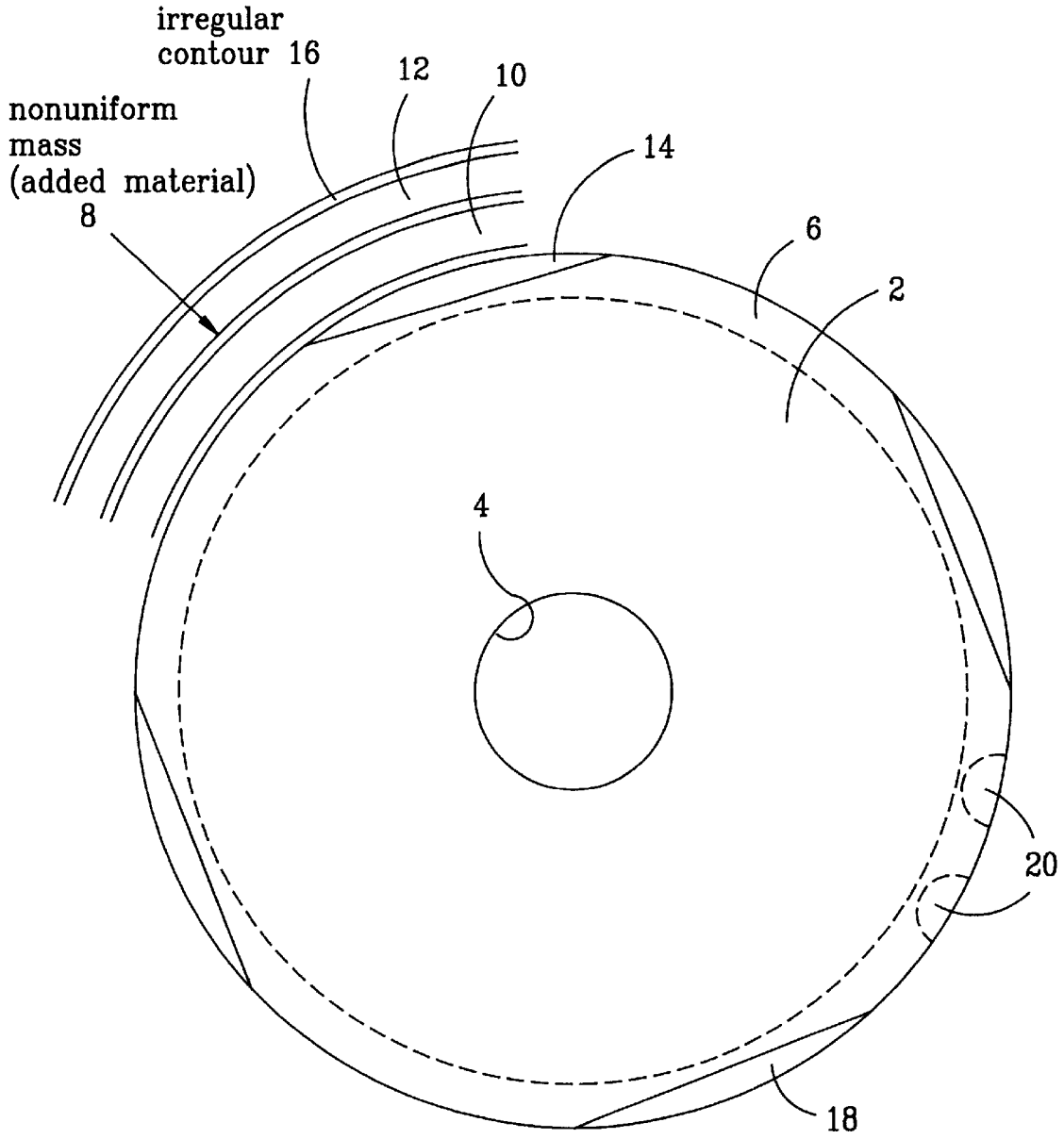
Figure 2:
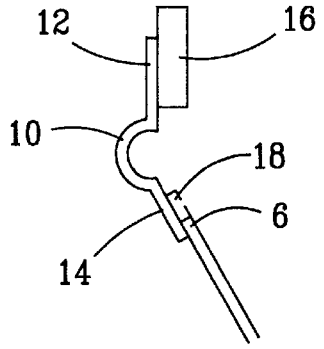
FIG. 2 is a sectional view of an edge area thereof.

The illustrated diaphragm 2 has a fully conventional, central connection with a voice coil 4, from which the diaphragm projects conically widening forwardly to an outer edge area 6 which, by means of glue, is joined with an edge suspension element 8. This element comprises an annular shell body 10 of a half circular cross section, extended into an exterior ring flange 12 and an interior, conical ring flange 14, to which the diaphragm 6 is glued. The exterior flange 12 is used for the mounting of the diaphragm on the outer chassis 16 of a loudspeaker.

Conventionally, the edge area 6 is a regular edge zone, but in accordance with the present invention it is at more places along its periphery chord cut as shown at 18, e.g. such that the produced chord has its middle point located at the half of the width of the inner flange 14. At the cuts 18, therefore, it is still possible to safely secure the diaphragm edge. Five rotation symmetrical cuts are shown, but the number may be both higher and lower, and besides, they need not be rectilinear, as they may be e.g. arched or welled; moreover, it may even be preferred to arrange them in an irregular manner along the edge.

The cuts give rise to local changes in two respects, viz. partly a reduced diaphragm mass and thus a slightly reduced diaphragm inertia and partly an exposure of a part of the inner flange 14, whereby this part gets the opportunity to participate in the movable, resilient system, such that the spring action on the remaining diaphragm portion becomes slightly reduced.

The said advantageous effect has been found with the use of five cuts, but also with only two cuts. With the use of narrower cuts or incisions it will be possible to highly increase the number, e.g. as shown at 20. Moreover, it has been found that a corresponding effect is achievable by means other than cuttings, e.g. by local material additions in order to influence the mass distribution or by local modifications of the edge suspension for changing the mass and/or the spring effect. However, it will be appreciated that the illustrated solution with simple cuts will be very easy in production. It remains to be mentioned that a further possibility is to provide the rigid chassis flange 16 with an irregular edge shape, hereby the associated flange of the edge suspension will participate in the resilient system in a correspondingly differentiated manner.

The invention will be applicable also in connection with oval loudspeakers as well as in connection with stiff, flat diaphragms.

I claim:

1. In a loudspeaker of the type having a generally smooth diaphragm which is connected to a loudspeaker voice coil in a center area of the diaphragm and with a carrier flange of an associated loudspeaker chassis peripherally secured to the diaphragm by a resilient edge suspension that is connected between the carrier flange and an outer edge portion of the diaphragm along the complete circumference of the diaphragm, the improvement wherein at least one of the outer edge portion, edge suspension and carrier flange are provided with physical modifications along an annular area of the connection between the outer edge portion of the diaphragm and the carrier flange as a means for providing the edge suspension with circumferentially differentiated effective spring characteristics, said physical modifications comprising cutouts in portions of the outer edge area of the diaphragm at which the diaphragm is fixed to the edge suspension.

2. A loudspeaker according to claim 1, wherein said physical modifications comprise the outer edge area of the diaphragm at which the diaphragm is fixed to the edge suspension being provided with an irregular contour.

3. A loudspeaker according to claim 1, wherein said physical modifications comprise a nonuniform mass distribution in the edge suspension.

4. A loudspeaker according to claim 3, wherein the nonuniform mass distribution in the edge suspension comprises an edge upon which material has been locally added.

5. A loudspeaker according to claim 1, wherein said physical modifications comprise an irregular contour provided on an edge of the carrier flange of the chassis.

* * * * *